US008647184B2

(12) United States Patent
Kortuem et al.

(10) Patent No.: US 8,647,184 B2
(45) Date of Patent: Feb. 11, 2014

(54) ADJUSTABLE WIDTH VENT BAFFLE

(75) Inventors: Matt Kortuem, Blandon, PA (US); Palle Rye, Shillington, PA (US); Dave Rosten, Isanti, MN (US); Richard L. Partlow, Jr., Reading, PA (US)

(73) Assignee: Brentwood Industries, Inc., Reading, PA (US)

( * ) Notice: Subject to any disclaimer, the term of this patent is extended or adjusted under 35 U.S.C. 154(b) by 1102 days.

(21) Appl. No.: 12/181,993

(22) Filed: Jul. 29, 2008

(65) Prior Publication Data

US 2008/0280554 A1 Nov. 13, 2008

Related U.S. Application Data

(63) Continuation-in-part of application No. 10/811,632, filed on Mar. 29, 2004, now Pat. No. 7,094,145, and a continuation-in-part of application No. 11/263,735, filed on Nov. 1, 2005, now abandoned.

(51) Int. Cl.
*F24F 7/02* (2006.01)

(52) U.S. Cl.
USPC ..... 454/260; 454/366; 52/95

(58) Field of Classification Search
USPC ..... 454/260, 366, 367; 52/199, 94, 95, 198
See application file for complete search history.

(56) References Cited

U.S. PATENT DOCUMENTS

| | | | | |
|---|---|---|---|---|
| 4,189,878 | A * | 2/1980 | Fitzgerald | 52/95 |
| 4,581,861 | A * | 4/1986 | Eury | 52/95 |
| 5,007,216 | A * | 4/1991 | Pearson | 52/94 |
| 5,600,928 | A * | 2/1997 | Hess et al. | 52/309.4 |
| 6,061,973 | A * | 5/2000 | Accardi et al. | 52/90.1 |
| 6,346,040 | B1 * | 2/2002 | Best | 454/260 |
| 6,347,991 | B1 * | 2/2002 | Bogrett et al. | 454/260 |
| 6,357,185 | B1 * | 3/2002 | Obermeyer et al. | 52/95 |
| 6,754,995 | B1 * | 6/2004 | Davis et al. | 52/95 |
| 7,302,776 | B2 * | 12/2007 | Duncan et al. | 52/95 |
| 2005/0215192 | A1 * | 9/2005 | Rye et al. | 454/260 |
| 2007/0151177 | A1 * | 7/2007 | Mumaw et al. | 52/198 |
| 2010/0146892 | A1 * | 6/2010 | Rider et al. | 52/302.3 |
| 2011/0030287 | A1 * | 2/2011 | Moore | 52/95 |

FOREIGN PATENT DOCUMENTS

JP 2007198005 A * 8/2007

* cited by examiner

*Primary Examiner* — Steven B McAllister
*Assistant Examiner* — Jamil Decker
(74) *Attorney, Agent, or Firm* — Miller Law Group, PLLC

(57) ABSTRACT

An adaptable vent baffle mountable to an underside of a roof deck and to a wall plate of a building structure between a pair of roof rafters having a rafter spacing for permitting ventilation between a soffit and an attic space of the building structure. A main body portion has a longitudinal axis and is positioned generally on a main body place. A spacer extends from the main body portion and a tail portion is hingedly mounted to the main body portion. The main body portion and tail portion include first and second side edges and a baffle width is defined between the first and second side edges. At least one line of weakness extends generally parallel to the longitudinal axis for modifying the baffle width to adapt to the rafter spacing.

16 Claims, 8 Drawing Sheets

ADJUSTABLE WIDTH VENT BAFFLE

CROSS-REFERENCE TO RELATED APPLICATIONS

This application is a continuation-in-part application of U.S. patent application Ser. No. 10/811,632, filed on Mar. 29, 2004 now U.S. Pat. No. 7,094,145 and entitled, "Vent Baffle and Method of Installation", and a continuation-in-part of U.S. patent application Ser. No. 11/263,735, filed on Nov. 1, 2005, now abandoned and entitled, "Vent Baffle and Perforation Machine", the disclosure of both applications being incorporated herein by reference.

FIELD OF THE INVENTION

The invention is in the field of building construction materials and particularly relates to attic vent baffles commonly used in residential building structures to allow ventilation flow through soffit vents into an attic space.

BACKGROUND OF THE INVENTION

It is known to provide attic ventilation systems to properly ventilate the attic space often found in buildings. Ventilation of the attic space is desirable to help prevent formation of condensation along the interior surface of the roof, which can damage attic insulation and the building structure itself. Proper ventilation also helps to prevent premature melting of snow accumulated on a building roof. Such premature melting can lead to the formation of ice on the roof. Such ice formations can be both a safety hazard and can lead to roof damage.

Known attic ventilation systems typically comprise a plurality of vents located in the underside, or soffit, of eaves extending from the building roof. Typically, air travels through the soffit vents into the attic space via an opening (herein referred to as the "roof-wall plate opening") between the underside of the roof deck and the top of the exterior wall of the building (the so-called "wall plate") and subsequently through an air flow channel formed by a vent baffle disposed adjacent the underside of the roof deck. Ventilation flow typically exits from the air flow channel into the attic space. The attic space may be provided with a separate roof vent to facilitate flow of air from the attic space to the outdoors.

An attic ventilation system directs and controls the ventilation air flow, as otherwise uncontrolled air currents can be sufficiently strong to disturb placement of attic insulation, blowing the insulation about to create areas which are not properly insulated. Uncontrolled air currents circulating in the attic space can also negatively affect performance of the attic insulation by promoting increased convective heat transfer along the top surface of the insulation.

An attic ventilation system also accommodates installation of attic insulation over the entire ceiling, as nearly as possible up to the roof-wall plate opening. To do this, ventilation systems preferably make some provision to block intrusion of insulation into the interior space of the eaves (such intrusion could lead to blockage of the soffit vents) while also providing an air flow channel to permit and control air flow through the soffit vents into the attic space.

U.S. Pat. No. 6,357,185 (Obermeyer) describes a known attic ventilation system and includes a rafter air infiltration block used in conjunction with a conventional roof vent board. The block of Obermeyer is a generally rectangular sheet of material having a plurality of tabs connected to a remainder of the sheet by a plurality of fold lines. The block of Obermeyer serves to prevent intrusion of insulation disposed proximate the roof-wall plate opening into the eave interior space, while the roof vent board provides an air flow channel to allow and control air flow from the soffit vents into the attic space. Installation of a roof ventilation system in accordance with the invention of Obermeyer requires installation of a roof vent board, as well as separate installation of the separate block component. Installation of the block component of Obermeyer requires the installer to fold the block component along multiple fold lines. The installation process is thereby complicated by the need to install two separate components and also by the need to fold the block component along multiple fold lines.

U.S. Pat. No. 6,346,040 (Best) discloses a ventilation panel comprising a rectangular sheet divided by a plurality of fold lines into a rectangular central portion, a pair of side edge portions and an end portion. When the side edge portions and end portions are folded into place, the ventilation panel of Best forms both an airflow channel and a roof-wall plate opening block. In order to install the ventilation panel of Best, it is necessary that the sheet be cut and folded at multiple locations, thus necessitating a relatively complicated and time-consuming installation process.

U.S. Pat. No. 4,581,861 (Eury) discloses a baffle board having side tabs and an end tab, each of the tabs being connected to a remainder of the baffle board by either perforated lines or score lines along which the tabs are bent relative to the remainder of the baffle board. Similar to the ventilation panel of Best, when the baffle board of Eury is folded into an installation configuration, the baffle board forms both an air flow channel and a roof-wall plate opening block. In order to install the baffle board of Eury, it is thus necessary to fold the board along multiple lines. It is further necessary for the installer to exercise judgment regarding the proper positioning of the baffle board (compare FIGS. 4 and 5 of Eury, which illustrate that an installer would be required to judge both the proper spacing of the baffle board from the underside of the roof deck and the proper angle of the baffle board relative to the roof).

There is a need for a vent baffle that is inexpensively manufactured, effectively provides ventilation and insulation baffling, is quickly and easily installed, and that may be installed in a wide range of building configurations. The present invention satisfies this need.

SUMMARY OF THE INVENTION

Briefly stated, in a first aspect the present application is directed to an adaptable vent baffle mountable to an underside of a roof and to a wall plate of a building structure between a pair of roof rafters having a rafter spacing for permitting ventilation between a soffit and an attic space of the building structure. The vent baffle includes a main body portion having a longitudinal axis and being positioned generally on a main body plane. A spacer extends generally perpendicularly from the main body relative to the main body plane and a tail portion is hingedly mounted to the main body portion. The main body portion and tail portion include first and second side edges extending generally parallel to the longitudinal axis. A baffle width is defined between the first and second side edges. At least one line of weakness extends generally parallel to the longitudinal axis for modifying the baffle width to adapt to the rafter spacing.

It is an object of this invention to provide a vent baffle structure that can be utilized in varying rafter spacings to provide an air flow path from the soffit to the roof vent that allows air to move past the insulation.

It is a feature of this invention that the vent baffle structure is formed with end spacer members that establish a proper spacing from the roof of the building to the main body of the vent baffle for the flow of air past the insulation layer of the building.

It is another feature of this invention that the vent baffle structure is formed with intermediate spacers that are discontinuous with the end spacers to establish a flexible intermediate portion between the end spacers and the intermediate spacers.

It is an advantage of this invention that the flexible intermediate portion between the end spacers and the intermediate spacers allow the main body portion of the vent baffle to bend for proper installation in certain building roof configurations.

It is another advantage of this invention that the intermediate spacers can be positioned against the building roof in alignment with the end spacers in certain building roof configurations.

It is still another feature of this invention that the vent baffle includes a plurality of lines of weakness formed in the vent baffle to provide tear-away strips to change the effective width of the vent baffle.

It is yet another feature of this invention that the multiple lines of weakness are placed at different spacings from the respective edges of the vent baffle to permit finitely variable width adjustments for the vent baffle.

It is still another advantage of this invention that the adjustable width vent baffle can be sized to fit between substantially any roof rafter spacing.

It is a further feature of this invention that the vent baffle is also formed with two lines of weakness near the center of the vent baffle structure to permit the vent baffle to be sized to fit into a half-size roof rafter spacing.

It is still a further feature of this invention that the lines of weakness extend from one end of the vent baffle to the other.

These and other objects, features and advantages are accomplished according to the instant invention by providing an adjustable width vent baffle mountable to an underside of a roof deck and to a wall plate of a building structure between a pair of roof rafters having a rafter spacing for permitting ventilation between a soffit and an attic space of the building structure. A main body portion has a longitudinal axis and is positioned generally on a main body place. A spacer extends from the main body portion and a tail portion is hingedly mounted to the main body portion. The main body portion and tail portion include first and second side edges and a baffle width is defined between the first and second side edges. At least one line of weakness extends generally parallel to the longitudinal axis for modifying the baffle width to adapt to the rafter spacing.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
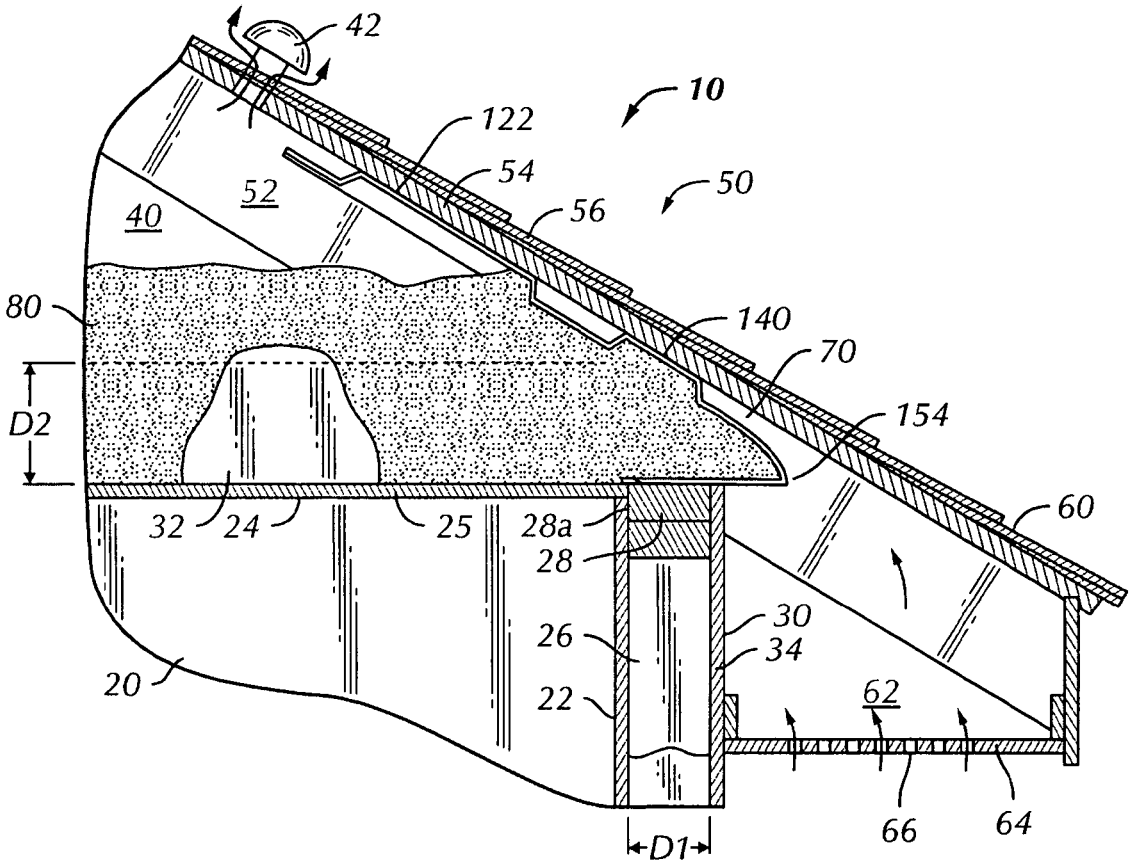
FIG. 1 is a cross-sectional view through a roof, wall and ceiling of a building structure, showing a vent baffle in accordance with one preferred embodiment of the present invention in an installed configuration to block a roof-wall plate opening of a first size.

Certain terminology is used in the following description for convenience only and is not limiting. The words "right", "left", "top", and "bottom" designate directions in the drawings to which reference is made. The words "interior" and "exterior" refer to directions towards and away from, respectively, the geometric center of the vent baffle or designated parts thereof. Furthermore, as used herein, the word "a" or a singular component includes the plural or more than one component, unless specifically and explicitly restricted to the singular or a single component or unless a singular meaning is apparent from the context. The terminology includes the words above specifically mentioned, derivatives thereof and words of similar meaning.

Referring to the drawings, wherein like reference numerals are used to designate the same components throughout the figures, there is shown in FIGS. 1-7 two preferred, non-limiting embodiments of a vent baffle 100. The vent baffle 100 is attachable to an underside of a roof deck 54 and to a wall plate 28 of a building structure 10.

Figure 2:
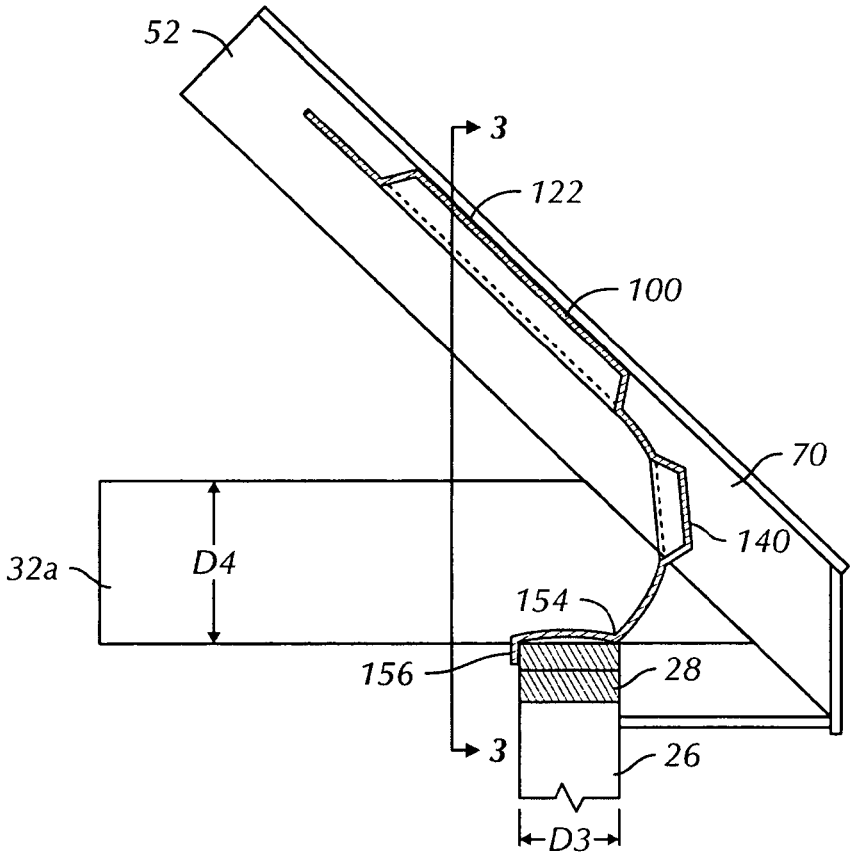
FIG. 2 is a cross-sectional view through a roof, wall and ceiling of a building structure, showing the vent baffle of FIG. 1 in an installed configuration to block a roof-wall plate opening of a second size.
Figure 3:
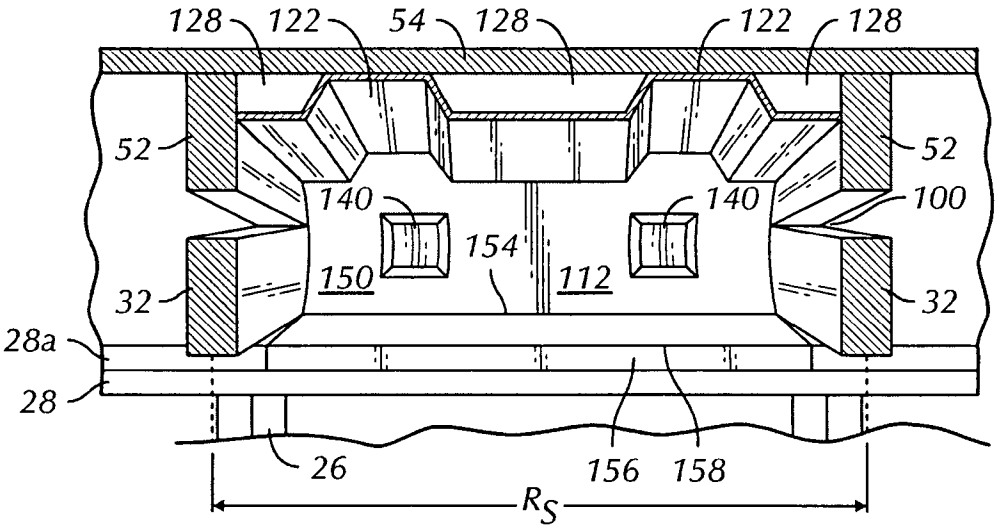
FIG. 3 is an interior perspective view of the vent baffle of FIGS. 1 and 2, oriented toward an exterior of the building structure and taken along line 3-3 of FIG. 2.

With particular reference to FIGS. 1-3, the building structure 10 is of conventional construction, and includes an interior room 20, an attic space 40, and a roof structure 50. The interior room 20 has an exterior wall 30 preferably formed by an assembly of interior wall board 22, wall studs 26 and an exterior wall covering 34 (a variety of well-known conventional materials including wood, vinyl or brick may be used for the exterior wall covering 34). The" exterior wall 30 separates the interior room 20 from the outdoors 12. The wall plate 28 forms a top portion of the exterior wall 30. The interior room 20 further includes a ceiling 24 formed by ceiling wall boards 25 attached to ceiling joists 32. The ceiling joists 32 also function as attic floor joists. Typically, insulation 80 is installed over the ceiling 24 to insulate the interior room 20 of the building structure 10.

The roof structure 50 includes the roof deck 54 attached to roof rafters 52. Shingles 56 are attached to the roof deck 54. The roof rafters 52 and ceiling joists 32 may be supplied as a pre-assembled roof truss assembly or alternatively may be assembled at the construction site. The roof structure 50 preferably includes eaves 60 extending beyond the exterior wall 30. The eaves 60 include an interior space 62 and an underside, or "soffit" 64. The eave interior space 62 is vented to the outdoors 12 by soffit vents 66.

Sets of the roof rafters 52 and ceiling joists 32 connect together with the wall plate 28 and the roof rafters 52 typically have a rafter spacing $R_S$ of two feet (2') between adjacent sets of roof rafters 52 and ceiling joists 32. The roof-wall plate opening 70 is formed between adjacent sets of roof rafters 52 and ceiling joists 32. This roof-wall plate opening 70 may vary in size, depending upon size of the ceiling joists 32, size of the roof rafters 52, the rafter spacing $R_S$ of the ceiling joists 32 and roof rafters 52 (typically twenty-four inches (24")) and arrangement of the connection between the ceiling joists and roof rafters. For example, a ceiling joist 32 having a first height D2 is illustrated in FIG. 1, while a ceiling joist 32*a* having a height D4 (larger than D2) is illustrated in FIG. 2. The roof-wall plate opening 70 corresponding to ceiling joist 32 is smaller than the roof-wall plate opening 70 corresponding to ceiling joist 32*a*. Note further that the width of the wall plate 28 may vary, with the wall plate 28 (and wall studs 26) having a first width D1 (for example, D1 corresponding to the width of conventional two by four inch (2×4") lumber) (FIG. 1) or having a second width D3 (for example, D3 corresponding to the width of conventional two by six inch (2×6") lumber) (FIG. 2). Furthermore, the pitch of the roof 50 may vary from one building structure 10 to another.

As discussed above, it is desirable to provide ventilation from the outdoors 12, through the soffit vents 66, into the eave interior space 62, through the roof-wall plate opening 70 and into the attic space 40, as depicted by the directional arrows in FIG. 1. The attic 40 may be provided with a passive or motor-driven fan vent 42 to increase and/or control the rate of ventilation flow.

With reference now primarily to FIGS. 1-6, the vent baffle 100 comprises a single-piece, unitary body, having a first face 110 and a second face 112. The vent baffle 100 preferably has a first end 102, a second end 104, a first side edge 106 and a second side edge 108. A central longitudinal axis 101 extends between the first and second ends 102, 104. The first and second side edges 106, 108 preferably extend generally parallel to the longitudinal axis 101 and the first and second ends 102, 104 are preferably positioned generally perpendicular to the longitudinal axis 101, but are not so limited. A main body portion 120 is proximate the first end 102 and has a main body plane defined by the first face 110. At least one and, preferably, two elongated end spacers 122 extend generally perpendicularly from the first face 110 of the main body 120 relative to the main body plane 120*a*. Preferably, the end spacers 122 are closer to the first end 102 than the second end 104. A tail portion 150 is connected to the main body portion 120, and is proximate the second end 104. Preferably, the tail portion 150 is movably connected to the main body portion 120 by a single flexible hinge 154. As described in detail below, when the vent baffle 100 is installed in the building structure 10, it is necessary, for the embodiment of the vent baffle 100 shown in FIGS. 1-6, that the installer bend the vent baffle 100 along this single hinge 154.

Figure 6:
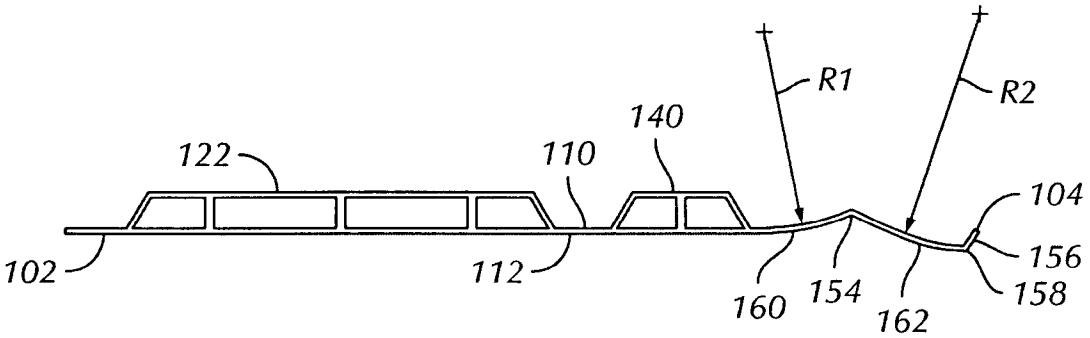
FIG. 6 is a side elevational view of the vent baffle of FIG. 4.

In one preferred embodiment, the hinge 154 is formed by an intersection of two preformed radiused sections 160 and 162. More particularly, as is best illustrated in FIG. 6, an end of the main body portion 120 extending toward the second end 104 includes a first radiused section 160, formed along a radius R1 located with respect to the side of the vent baffle corresponding to the first face 110. A second radiused section 162 extending between the first radiused section 160 and the second end 104 follows a radius R2 also located with respect to the first face 110 side of the vent baffle 100. The hinge 154 is not scored, cut or perforated. The vent baffle 100 has substantially the same thickness in the main body portion 120, the tail portion 150 and at the hinge 154.

Preferably, the tail portion 150 has a flange 156 disposed at the second end 104, the flange 156 being connected to a remainder of the tail portion 150 by a preferably single preformed bend 158. Preferably, the preformed bend forms an angle in the range of about 70 to about 110 degrees between the flange 156 and the remainder of the tail portion 150 (the angle being measured along the first face 110). Like the hinge 154, the bend 158 is not scored, cut or perforated and the bend 158 has substantially the same thickness as other portions of the vent baffle 100.

With particular reference to FIGS. 1-4B, the main body portion 120 is adapted to be fixedly attached to the underside of the roof deck 54 between the roof rafters 52 and ceiling joists 32, such that the end spacer 122 is positioned adjacent the underside of the roof deck 54, creating at least one air flow channel 128 between the first face 110 and the underside of the roof deck 54. In the preferred embodiment, having two end spacers 122, there are three air flow channels 128 including an air flow channel 128 disposed along first and second side edges 106 and 108 of the vent baffle 100 between the spacers 122 and the roof rafters 52 and another air flow channel 128 disposed between the two end spacers 122. The vent baffle 100 preferably has a baffle width $W_B$ of approximately twenty-two and one-half inches (22½") such that the first and second side edges 106, 108 abut or are in close proximity to the roof rafters 52 in an installed position. The first and second side edges 106, 108 preferably abut or are in close proximity to the roof rafters 52 to generally prevent gaps that preferably prevent insulation 80 from escaping out of the attic space 40 through the gaps or for wind to disturb the insulation in the attic space 40 by blowing through the gaps. Furthermore, the flange 156 is adapted to be fixedly attached to the wall plate 28, preferably along an interior side 28*a* of the wall plate 28 to further stabilize the vent baffle 100 and generally prevent the insulation 80 from being disturbed by airflow.

The main body portion 120 may further comprise at least one, and preferably two, intermediate spacers 140 to define an intermediate body portion forming part of the main body portion disposed between the end spacers 122 and the tail portion 150. Like the end spacers 122, the intermediate spacers 140 extend in the first direction from the first face 110. The intermediate spacers 140 are discontinuous from the end spacers 122 to define a flexible planar portion between the end spacers 122 and the intermediate spacers 140, as is specifically depicted in FIG. 2. When the vent baffle 100 is installed in a first installation configuration as shown in FIG. 1, wherein the roof-wall plate opening 70 is relatively small, without the tail portion 150 sagging inwardly away from the roof deck 54, the intermediate spacers 140 enhance the function of the end spacers 122 by bearing against the underside of the roof deck 54. In some installations, the intermediate spacers 140 may act as stiffeners in the direction of the longitudinal axis 101 of the vent baffle 100. In such installations, the flexible portion between the end spacers 122 and the intermediate spacers 140 tend to force the vent baffle 100 into a "bowed out" second installed configuration as shown in FIG. 2 when the vent baffle 100 is installed in a building structure 10 having a relatively large roof-wall plate opening 70. Thus, the intermediate spacers 140 tend to position the vent baffle 100 into the desired installed position, irrespective of the particular dimensions of the roof-wall plate opening 70 of the building structure 10.

Figure 4:
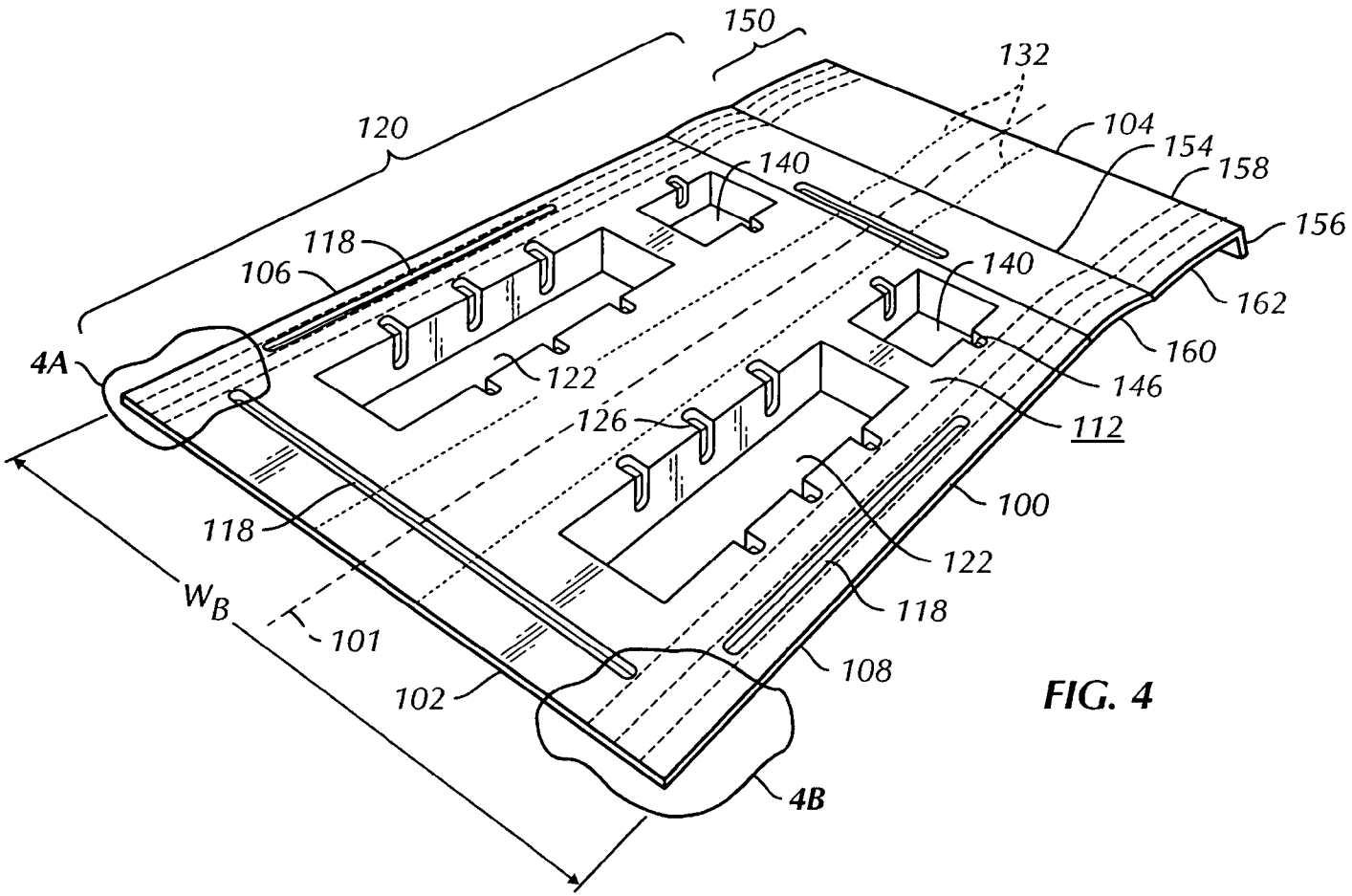
FIG. 4 is a perspective view of a first face of the vent baffle of FIGS. 1 and 2, shown in an uninstalled configuration.
Figure 4A:
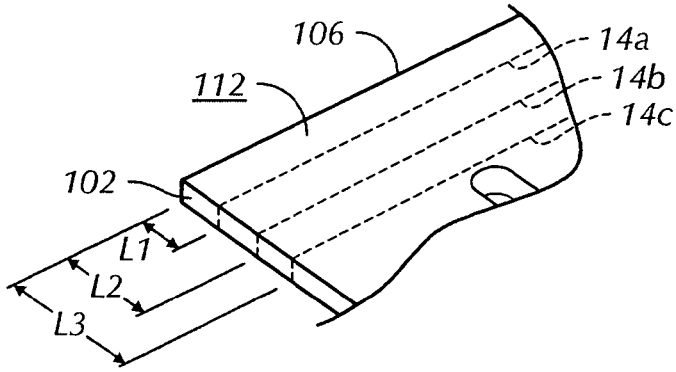
FIG. 4A is a greatly magnified perspective view of the vent baffle taken from the circle 4A of FIG. 4 showing perforated lines at a corner portion of the vent baffle.
Figure 4B:
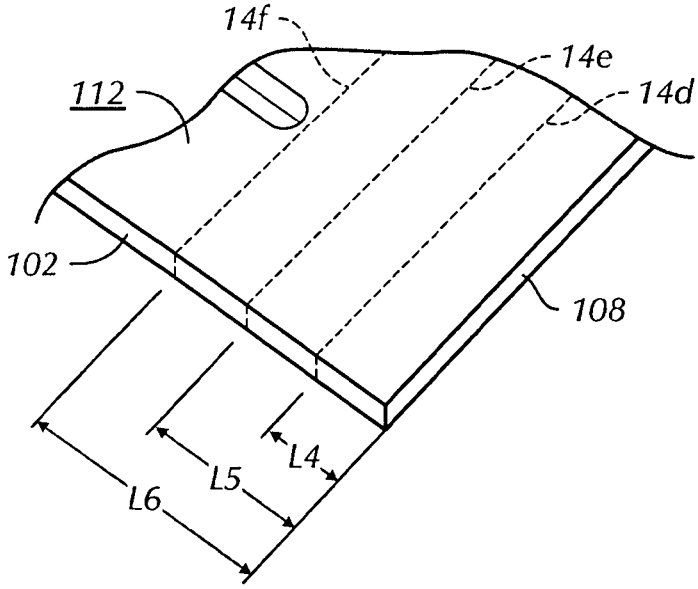
FIG. 4B is a greatly magnified perspective view of the vent baffle taken from the circle 4B of FIG. 4 showing perforated lines at a corner portion of the vent baffle.
Figure 5:
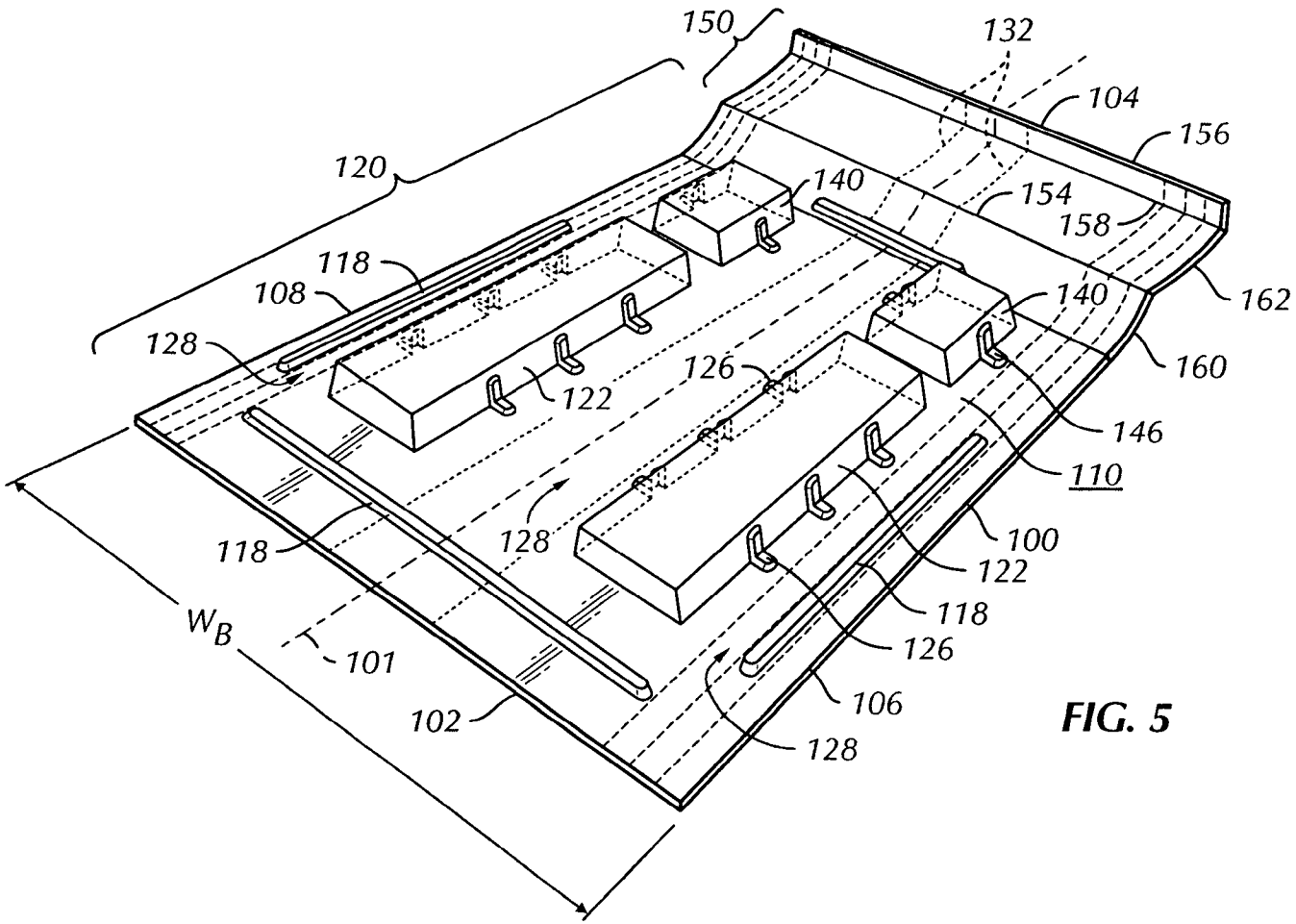
FIG. 5 is a perspective view of a second face of the vent baffle of FIG. 4.
Figure 7:
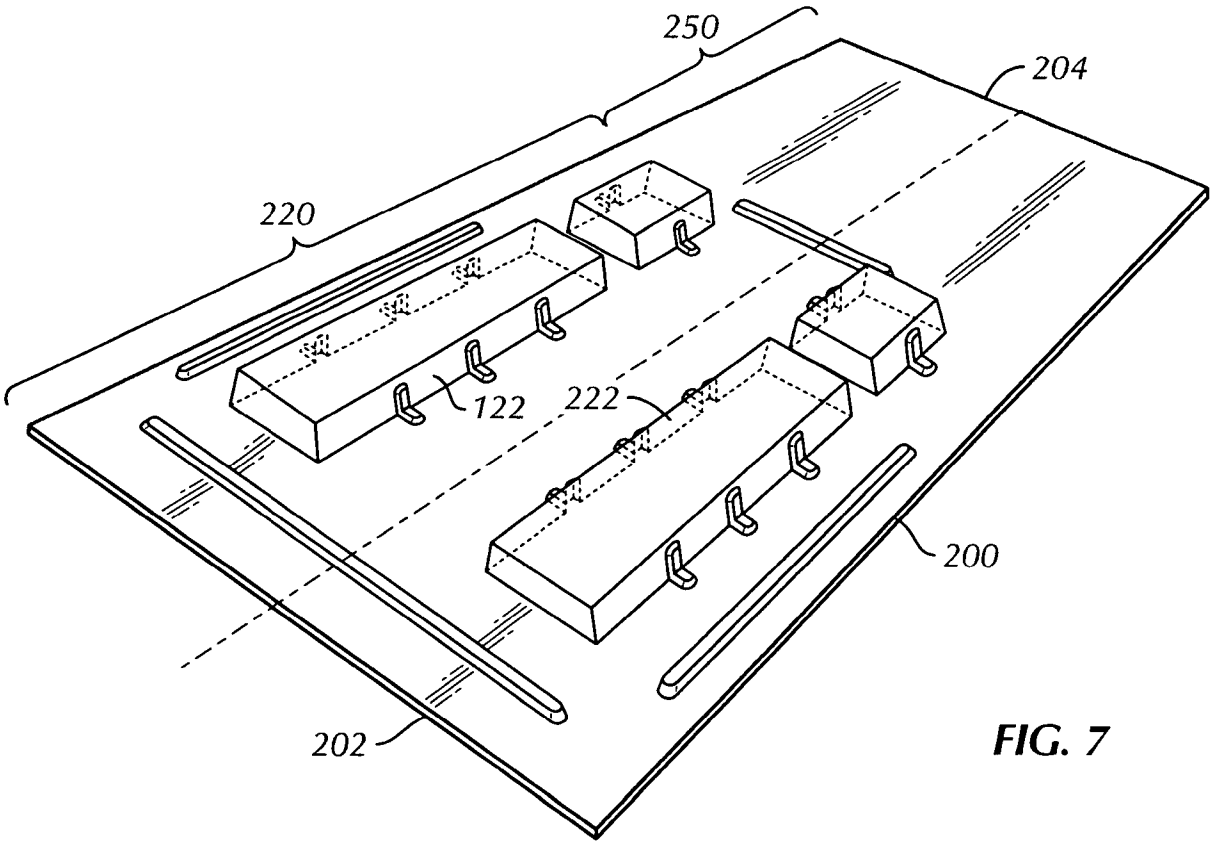
FIG. 7 is a perspective view of another embodiment of the present invention, shown in an uninstalled configuration.

An edge stiffener 118, shown only in the embodiments illustrated in FIGS. 4, 5 and 7, optionally, but preferably, may be disposed along at least one of the first end 102 and portions of the two side edges 106, 108, and is preferably disposed along each of the first end 102 and portions of the side edges 106, 108 proximate the first end 102. Similarly, the end spacers 122 and intermediate spacers 140 may further comprise at least one, and preferably a plurality, of side stiffeners 126, 146, respectively. In the preferred embodiment, the side stiffeners 126, 146 are formed unitarily with the end and intermediate spacers 122, 140, respectively, by conventional thermal forming or molding techniques. Preferably, the stiffeners 118 along the side edges 106, 108 have a length substantially equal to the end spacers 122 without interfering with the flexible planar portion between the end spacers 122 and the intermediate spacers 140.

The vent baffle 100 is a flexible sheet preferably having a thickness of about 0.010 inch to about 0.040 inch. Sheet metals, thermoplastics, and composite materials composed of fibers impregnated with thermoplastic materials can all be used to form the vent baffle 100. Sheet metals such as galvanized steel, stainless steel, aluminum and copper can be formed into vent baffles for use in the present invention. Thermoplastic materials which can be used in the present invention are, for example, polyvinyl chlorides (plasticized or unplasticized), polystyrenes, acetals, nylons, acrylonitrile-butadiene-styrene (ABS), styrene-acrylonitrile (SAN), polyphenylene oxides, polycarbonates, polyether sulfones, polyaryl sulfones, polyethylene, polystyrene, terephthalates, polyetherketones, polypropylenes, polysilicones, polyphenylene sulfides, polyionomers, polyepoxides, polyvinylidene halides, and derivatives and/or mixtures thereof. The particular material used is dependent upon the desired end use and the application conditions associated with that use, as is well known in the art. Presently it is preferred that a synthetic polymer, such as polyvinyl chloride, polypropylene, ABS, or polystyrene, be used to form the vent baffle 100.

The vent baffle 100 is preferably fabricated using conventional thermal forming techniques well known in the art of molding. From this disclosure, the artisan will recognize that the geometrical design of the vent baffle 100 allows a simple one-step manufacturing process, reducing the cost of fabrication. The artisan will further recognize from this disclosure that multiple vent baffles 100 may be stacked on top of one another in a nested arrangement for storage and shipment, facilitating transport of the vent baffles 100.

Referring to FIGS. 3-5, the vent baffle 100 may be provided with at least one line of weakness 132, **14*a*-14*f* extending over at least a portion of the main body 120 to facilitate cutting and/or tearing the vent baffle 100 into smaller portions for installation between adjacent sets of roof rafters 52 and ceiling joists 32 having less than the two foot (2') standard spacing or to adapt the vent baffle for insertion between roof rafters 52 having nearly any atypical rafter spacing $R_S$. Specifically, in the preferred embodiment, the vent baffle 100 includes one or more score lines 132 (best seen in FIG. 4) extending generally parallel to the longitudinal axis 101 near a middle portion of the vent baffle 100 for cutting the vent baffle 100 into two portions. In addition, the preferred vent baffle 100 includes perforated lines 14*a*-14*f* extending generally parallel to the longitudinal axis 101 proximate the first and second side edges 106, 108 for tearing the vent baffle 100 to modify the baffle width $W_B$. The score lines 132 and perforated lines 14*a*-14*f* preferably extend from the first end 102 to the second end 104 generally parallel to the longitudinal axis 101, but are not so limited. For example, the score lines 132 or perforated lines 14*a*-14*f* may extend at an angle to the longitudinal axis 101 to adapt to roof rafters 52 that taper at they extend toward a peak of the building structure 10 or may extend along nearly any path on the vent baffle 100 to accommodate specific features of the building structure 10 and rafters 52 or joists 32**.

Referring to FIGS. 4-5, the perforated lines **14*a*-14*f* are preferably comprised of a first perforated line 14*a*, a second perforated line 14*b*, a third perforated line 14*c*, a fourth perforated line 14*d*, a fifth perforated line 14*e* and a sixth perforated line 14*f* that extend along the vent baffle 100 generally parallel to the longitudinal axis 101 and the first and second side edges 106, 108. The first, second and third perforated lines 14*a*, 14*b*, 14*c* are preferably positioned at first, second and third distances L1, L2, L3 from the first side edge 106 and the fourth, fifth and sixth perforated lines 14*d*, 14*e*, 14*f* are preferably positioned at fourth, fifth and sixth distances L4, L5, L6 from the second side edge 108. In the preferred embodiment, the first distance L1 is three-quarters of an inch (¾"), the second distance L2 is two and one-quarter inches (2¼"), the third distance L3 is four inches (4"), the fourth distance L4 is one-half inch (½"), the fifth distance L5 is three inches (3") and the sixth distance L6 is four inches (4"). The baffle width $W_B$ and first, second, third, fourth, fifth and sixth distances L1-L6 are not limited to the above-listed values and may take on nearly any value that permits adapting the vent baffle 100 for a particular building structure 10 or alternate application. The vent baffle 100 may be torn along one or more of the perforated lines 14*a*-14*f* to modify the baffle width $W_B$ to adapt the vent baffle 100** for various rafter spacings $R_S$.

In use, the vent baffle 100 of the present invention is installed to the underside of the roof deck 54 and to the wall plate 28 in several steps. In a first step the user provides a vent baffle 100 and positions the vent baffle 100 such that the spacer 122 is adjacent the underside of the roof deck 54 between adjacent roof rafters 52. When the spacer 122 is positioned adjacent the underside of the roof deck 54 at least one air flow channel 128 is created between the underside of the roof deck 54 and the first face 110. A portion of the tail portion 150 is positioned adjacent the wall plate 28 and the tail portion 150 may be angled relative to the main body portion 120 at the hinge 154 such that the vent baffle 100 substantially blocks the roofwall plate opening 70. This forms the baffle for channeling air flow from the soffit vents 66 into the attic space 40, while also retaining the insulation 80 within the attic space 40 such that the insulation 80 does not block the air flow. The vent baffle 100 may be readily placed in the proper position for installation, irrespective of the exact dimensions of the building structure 10 into which the vent baffle 100 is being installed. More particularly, with reference again to FIGS. 1-3, it is not necessary that the installer gauge the position of the vent baffle 100 relative to the underside of the roof deck 54 in order to obtain an air flow channel 128 of the appropriate size. That is, the spacers 122 and 140 automatically position the first face 110 at the proper distance from the underside of the roof deck 54.

Similarly, the flange 156 and hinge 154 aid in properly placing the vent baffle 100 relative to the wall plate 28 and roof deck 54. More particularly, when the flange 156 overlaps a portion of the interior side of the wall plate **28*a*, and the second radiused portion 162 is positioned adjacent a top of the wall plate 28, the main body portion 120 tends to position itself relative to the roof deck 54 and wall plate 28 in the proper position along the longitudinal axis 101 of the vent baffle 100, such that a full layer of insulation 80 can be installed over the entire ceiling 24. Accordingly, only minimal effort is required on the part of the installer to properly place the vent baffle 100** into the installation position.

Depending upon the rafter spacing $R_S$, the vent baffle 100 may be directly inserted between the rafters 52 such that the first and second side edges 106, 108 abut or are in close proximity to the rafters 52. However, if the rafter spacing $R_S$ is atypical or the vent baffle 100 is being positioned between two end rafters (not shown) where the rafter spacing $R_S$ may be greater or less than for the remainder of the building structure 10, the baffle width $W_B$ may be modified by cutting or tearing the vent baffle 100 along one or more of the score lines 132 or the perforated lines 14*a*-14*f*. For example, if the rafter spacing $R_S$ of rafters 52 having a one and one-half inch (1½") thickness is sixteen inches (16"), the third and sixth perforated lines 14*c*, 14*f* are torn by a user resulting in a vent baffle 100 having a baffle width $W_B$ of fourteen and one-half inches (14½") that may be inserted between the two adjacent rafters 52 such that the first and second side edges 106, 108 are abutting or in close proximity to the rafters 52.

In addition, for a building structure 10 having a standard two foot (2') rafter spacing $R_S$, the vent baffle 100 having the twenty-two and one-half (22½") baffle width $W_B$ may be inserted directly between the rafters 52 without tearing or cutting the vent baffle 100. Further, at an end of a building structure 10 wherein a rafter spacing $R_S$ is one foot (1'), the vent baffle 100 may be cut along one of the score lines 132 resulting in a vent baffle 100 having a single spacer 122 and the creation of two air flow channels 128 between the spacer 122 and the rafters 52 when the vent baffle 100 is inserted into the end rafters 52 of the building structure 10. This vent baffle 100 would preferably have a baffle width $W_B$ of approximately ten and one-half inches (10½"). In addition, multiple vent baffles 100 or portions of the vent baffles 100 may be adapted for insertion side-by-side between roof rafters 52 having a rafter spacing $R_S$ that is larger than the baffle width $W_B$.

In another step, the tail portion 150 is preferably first secured to the wall plate 28 followed by the main body portion 120 being secured to the underside of the roof 54. Alternatively, the main body portion 120 could be secured to the underside of the roof 54 prior to the tail portion 150 being secured to the wall plate 28. Preferably, the main body portion 120 and the flange 156 are fixedly attached to the roof deck 54 and the interior side 28*a* of the wall plate 28, respectively, preferably using staples. Other mechanical fasteners or adhesive could also be used to attach the main body portion 120 and/or the flange 156.

Once the vent baffles 100 are installed, insulation 80 can then be installed in the attic space 40. Insulation 80 typically can be installed as batts laid between the ceiling joists 32 or by blowing loose insulation into the attic space 40. Blown-in insulation 80 is illustrated in FIG. 1. The ability to easily modify the baffle width W B of the vent baffle 100 when utilizing blown-in insulation 80 is preferred such that the first and second side edges 106, 108 are positioned in an abutting relationship or in close proximity to the adjacent rafters 52 such that the blown-in insulation 80 does not escape from the roof-wall plate opening 70 or wind does not blow in through the opening 70 to disturb the insulation 80.

With reference now to FIG. 7, another embodiment vent baffle 200 is similar to the first embodiment vent baffle 100 with the exception that the hinge 154 and the flange 156 are omitted. The second embodiment vent baffle 200 functions in generally the same manner as the first embodiment 100 and may be manufactured using the same materials and manufacturing techniques. When installed, a main body portion 220 is not angled relative to a tail portion 250 in an abrupt manner at a hinge, but rather the tail portion 250 is an extension or continuation of the main body portion 220. The tail portion 250 is connected near a second end 204 to the wall plate 28, the planar portions of the tail portion 250 and between the end spacers 122 and intermediate spacers permitting a bowed flexing of the vent baffle 20 as needed to secure the vent baffle to the building structure. Although not shown in FIG. 7, the vent baffle 200 of the second preferred embodiment may also includes lines of weakness 132, 14*a*-14*f* to permit modification of the baffle width $W_B$ to adapt the vent baffle 200 to various building structures 10.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An adaptable vent baffle mountable to an underside of a roof deck and to a wall plate of a building structure between a pair of roof rafters having a rafter spacing for permitting ventilation between a soffit and an attic space of the building structure, the vent baffle comprising: a main body portion having a longitudinal axis and being positioned generally on a main body plane; a spacer extending generally perpendicularly from the main body relative to the main body plane; a tail portion hingedly mounted to the main body portion, the main body portion and tail portion including first and second side edges extending generally parallel to the longitudinal axis along an entire length dimension from a first end to a second end of said vent baffle, a baffle width defined between the first and second side edges; and multiple parallel perforated lines spaced inwardly from each said side edge and extending generally parallel to the longitudinal axis along said entire length dimension of said vent baffle from said first end to said second end to permit selective longitudinally extending portions of each said side edge along said entire length dimension to be removed from said vent baffle along both said main body portion and said tail portion for modifying the baffle width to adapt to the rafter spacing, said perforated lines being spaced at irregular intervals from the corresponding said side edge such that each said perforated line defines a potential baffle width different from each other perforated line, whereby said first and second side edges can be configured by removing a selected portion thereof corresponding to a selected one of said perforated lines so that said baffle width will conform to and permit placement of said side edges adjacent to said pair of roof rafters irrespective of the spacing of said pair of roof rafters.

2. The vent baffle of claim 1 wherein the baffle width may be modified by tearing the vent baffle along at least one of the perforated lines such that the baffle width is adaptable to the rafter spacing of various buildings.

3. The vent baffle of claim 1 wherein the perforated lines along said first side edge are spaced differently than the perforated lines along said second side edge.

4. The vent baffle of claim 1 further comprising: a first edge stiffener extending generally perpendicularly from the main body portion and positioned generally parallel to the longitudinal axis proximate the first side edge; and a second edge stiffener extending generally perpendicularly from the main body portion and positioned generally parallel to the longitudinal axis proximate the second side edge.

5. The vent baffle of claim 4 further comprising: an end stiffener extending generally perpendicularly from the main body portion and positioned generally perpendicular to the longitudinal axis proximate a first end of the main body portion.

6. A vent baffle mountable to an underside of roof rafters and to a wall plate of a building structure to provide a passageway for air to move from a soffit structure past insulation to a roof vent, comprising:

a main body portion having a longitudinal axis and being positioned generally on a main body plane, said main body portion having a convoluted configuration from a first side edge to a second side edge that defines said passageway between said insulation on one side of said main body portion and a roof deck on an opposing side of said main body portion, said main body portion defining a first end of said vent baffle;

a tail portion extending from said main body portion for movement relative thereto, said tail portion being connectable to said wall plate when said main body portion is connected to said rafters, said tail portion defining a second end of said vent baffle spaced longitudinally from said first end; and at least two lines of weakness positioned along each of said side edges and extending longitudinally from said first end to said second end, the lines of weakness along said first side edge having a first irregular transverse spacing from said first side edge while said lines of weakness along said second side edge having a second irregular transverse spacing relative to said second side edge, said first irregular spacing being different than said second irregular spacing such that each said line of weakness is spaced from each other line of weakness at different spacing than the other lines of weakness such that each said line of weakness defines a potential baffle width different from each other line of weakness, said lines of weakness permitting a selective width of a longitudinally extending portion to be broken from said vent baffle by removing a selected portion thereof corresponding to a selected one of said lines of weakness to modify a width dimension thereof to adapt to variable rafter spacing so that said baffle width will conform to and permit placement of said side edges adjacent to the respective said roof rafters.

7. The vent baffle of claim 6 wherein said vent baffle includes three lines of weakness along each respective side edge, each said line of weakness comprises a perforated line extending longitudinally from said first end to said second end of said vent baffle.

8. The vent baffle of claim 7 further comprising:

a first edge stiffener extending generally perpendicularly from the main body portion and positioned generally parallel to the longitudinal axis proximate said first side edge and being located between two of said lines of weakness; and a second edge stiffener extending generally perpendicularly from the main body portion and positioned generally parallel to the longitudinal axis proximate said second side edge and being located between two of said lines of weakness.

9. The vent baffle of claim 6 wherein said main body portion is formed with a pair of end spacers projecting generally perpendicularly from said main body relative to said main body plane, said vent baffle further comprising:

an intermediate body portion integrally formed with said main body portion and having a pair of intermediate spacers projecting generally perpendicularly from said intermediate body relative to said main body plane, said intermediate spacers being spaced longitudinally from said end spacers and being separated by a flexible planar portion oriented generally transverse of said longitudinal axis that permits said intermediate body portion to be bent relative to said main body plane, said intermediate spacers permitting said passageway to extend past said intermediate body portion when said intermediate body portion is also connected to said rafters, said intermediate spacers being operable to stiffen said intermediate body portion when said intermediate body portion is bent relative to said main body portion.

10. The vent baffle of claim 9 further comprising:

a first edge stiffener extending generally perpendicularly from the main body portion and positioned generally perpendicular to the longitudinal axis proximate said first end of the main body portion; and a second edge stiffener extending generally perpendicularly from said intermediate body portion, said end spacers and said intermediate spacers being located between said first and second edge stiffeners.

11. The vent baffle of claim 7 wherein each respective said line of weakness has a different linear dimension from the corresponding side edge than any other line of weakness.

12. A vent baffle mountable to an underside of roof rafters and to a wall plate of a building structure to provide a passageway for air to move from a soffit structure past insulation to a roof vent, wherein the wall plate has an inside vertical face, an outside vertical face and an upper horizontal surface, and the roof rafters are mounted at a pitch angle to be positioned above the wall plate at a vertical distance from the upper horizontal surface to define a heel having a height varying from a first low height to a second high height, comprising:

a main body portion having a longitudinal axis and being positioned generally on a main body plane, said main body portion having at least one spacer extending generally perpendicularly from the main body relative to the main body plane to form a convoluted configuration from a first side edge to a second side edge that defines said passageway between said insulation on one side of said main body portion and a roof deck on an opposing side of said main body portion, said main body portion defining a first end of said vent baffle, said main body portion including a flexible portion; and a flexible tail portion extending from said main body portion and terminating in a second end of said vent baffle spaced longitudinally from said first end, said flexible portion of said main body portion being located between said spacers and said flexible tail portion, said flexible tail portion and said flexible portion of said main body portion being movable relative to said spacers with said tail portion being connectable to said wall plate when said main body portion is connected to said rafters such that said tail portion and said flexible portion of said main body portion curves from said main body portion to said second end to accommodate the height of the heel and various pitch angles of the roof structure;

at least one intermediate spacer located between said at least one spacer and said tail portion, said flexible portion of said main body portion including a planar flexible portion between said at least one spacer and said at least one intermediate spacer, said flexible portion of said main body portion further including a first radiused flexible portion located between said at least on intermediate spacer and said tail portion.

13. The vent baffle of claim 12 wherein said tail portion is formed with an angled mounting flange formed at said second end and being connectable to said inside vertical face of said wall plate when said tail portion is positioned along said upper horizontal surface of said wall plate.

14. The vent baffle of claim 13 wherein said tail portion is formed as a second radiused flexible portion terminating at said angled mounting flange.

15. A vent baffle mountable to an underside of roof rafters and to a wall plate of a building structure to provide a passageway for air to move from a soffit structure past insulation to a roof vent, wherein the wall plate has an inside vertical face, an outside vertical face and an upper horizontal surface, and the roof rafters are mounted at a pitch angle to be positioned above the wall plate at a vertical distance from the upper horizontal surface to define a heel having a height varying from a first low height to a second high height, comprising:

a main body portion having a longitudinal axis and being positioned generally on a main body plane, said main body portion having at least one spacer extending generally perpendicularly from the main body relative to the main body plane to form a convoluted configuration from a first side edge to a second side edge that defines said passageway between said insulation on one side of said main body portion and a roof deck on an opposing side of said main body portion, said main body portion defining a first end of said vent baffle;

a flexible tail portion extending from said main body portion and terminating in an angled mounting flange forming a second end of said vent baffle spaced longitudinally from said first end, said flexible tail portion being movable relative to said spacers with said angled mounting flange being connectable to said inside vertical face of said wall plate when said main body portion is connected to said rafters and said tail portion is positioned along said upper horizontal surface of said wall plate, said main body portion including a flexible portion located between said spacers and said flexible tail portion so that said tail portion and said flexible portion of said main body portion curves from said main body portion to said second end to accommodate the height of the heel and various pitch angles of the roof structure; and at least one intermediate spacer located between said at least one spacer and said tail portion, said flexible portion of said main body portion including a planar flexible portion between said at least one spacer and said at least one intermediate spacer.

16. The vent baffle of claim 15 wherein said flexible portion of said main body portion further includes a first radiused flexible portion located between said at least on intermediate spacer and said tail portion, said tail portion being formed as a second radiused flexible portion terminating at said angled mounting flange.

* * * * *